United States Patent [19]

Schneider

[11] Patent Number: 4,756,365

[45] Date of Patent: Jul. 12, 1988

[54] CEMENTING PLUG

[75] Inventor: David E. Schneider, Houston, Tex.

[73] Assignee: Weatherford U.S. Inc., Houston, Tex.

[21] Appl. No.: 903,818

[22] Filed: Sep. 4, 1986

[51] Int. Cl.[4] ..... E21B 33/16

[52] U.S. Cl. ..... 166/153; 166/202; 166/291

[58] Field of Search ..... 166/153, 155, 156, 173, 166/177, 202, 291; 15/104.06 R

[56] References Cited

U.S. PATENT DOCUMENTS

| | | | |
|---|---|---|---|
| 1,872,855 | 8/1932 | Walker | 166/153 X |
| 2,630,179 | 3/1953 | Brown . | |
| 2,717,645 | 9/1955 | Schnitter | 166/156 |
| 2,740,480 | 4/1956 | Cox . | |
| 3,006,415 | 10/1961 | Burns et al. | 166/156 |
| 3,145,778 | 8/1964 | Grekel et al. . | |
| 3,153,451 | 10/1964 | Chancellor et al. | 166/202 X |
| 3,842,905 | 10/1974 | Morrisett et al. | 166/155 |
| 3,948,322 | 4/1976 | Baker | 166/289 |
| 4,078,810 | 3/1978 | Arendt | 166/153 X |
| 4,083,074 | 4/1978 | Curtis | 15/104.06 R |
| 4,262,702 | 4/1981 | Streich | 138/89 |
| 4,378,838 | 4/1983 | Ogden et al. | 166/153 |
| 4,429,746 | 2/1984 | Allard | 166/291 |

OTHER PUBLICATIONS

American Petroleum Institute, "Oil Well Cementing Practices in the United States", p. 112 (1959).

*Primary Examiner*—George A. Suchfield
*Attorney, Agent, or Firm*—Vaden, Eickenroht, Thompson & Boulware

[57] ABSTRACT

A wiper for a wellbore plug which is rigid for breaking off breakaway members and wellbore plug having a first wiper flexible enough to bypass breakaway members and a second wiper rigid enough for breaking off the bypassed members.

2 Claims, 4 Drawing Sheets

CEMENTING PLUG

BACKGROUND OF THE INVENTION

1. Field of the Invention.

This invention relates to plugs for use in wellbores and particularly to plugs for use in operations in cased wellbores which require the breaking off of frangible breakaway members.

2. Prior Art.

Plugs are used for various purposes in wellbores and in wellbore operations. In cementing operations, plugs with flexible wipers are used to act as a barrier between cement and displacement fluid to prevent fluid/cement intermingling; to wipe off fluid such as drilling mud or cement from the interior casing wall; to provide means for indicating when cement has been displaced from within the casing; and to break off frangible breakaway members such as breakaway plugs which protrude into the casing.

The available plugs have proven to be unsatisfactory, particularly plugs which have to pass restrictions such as stage cementing tools. The flexible wipers of the prior art plugs are not rigid enough to insure that breakaway plugs are broken. A very serious problem created by the prior art plugs is the forward migration of broken off plugs, plug pieces, or other items which become lodged inside check valves, landing baffles or other operative members in the wellbore.

SUMMARY OF THE PRESENT INVENTION

The present invention is directed to an improved wellbore plug which overcomes the problems of prior art plugs in an efficient and unique manner. A plug according to the present invention has a first flexible wiper which is flexible enough to pass through restrictions in the casing without breaking frangible members with which it comes in contact and a second wiper which is relatively more rigid so that it breaks off the desired frangible members. Another wiper (which can be the second wiper) is provided which is large enough to prevent upward or rearward migration of any broken off member. The first wiper can be large enough to prevent downward or forward migration of the broken-off pieces and may be split or segmented. In effect, the broken-off pieces are contained in the space between two of the wipers.

The second wiper can be made of any inherently rigid material such as metal, rubber or plastic or it can have a portion made from a relatively hard or rigid material to enhance the wiper's ability to break the breakaway member. Such plugs are particularly useful in operations which require the breaking off of knock-off or breakaway plugs.

It is, therefore, an object of the present invention to provide a new and efficient wellbore plug.

Another object of the present invention is the provision of a new and efficient plug for cementing operations.

Yet another object of the present invention is the provision of a plug having a wiper flexible enough to bypass breakaway members and a following wiper rigid or strong enough to break off the bypassed breakaway members.

Still another object of the present invention is the provision of such a plug in which a containment space is created between two wipers to hold any broken off pieces and prevent their migration through the wellbore or casing.

A particular object of the present invention is the provision of such a plug in which the following wiper is made of a rigid material or has a portion which is rigid enough, hard enough, or strong enough to enhance the plug's ability to break off the breakaway members.

To one of skill in this art who has the benefits of this invention's teachings, other and further objects, features and advantages will be clear from the following description of presently preferred embodiments of the invention given for the purposes of disclosure, and taken in conjunction with the accompanying drawings.

DESCRIPTION OF THE PREFERRED EMBODIMENTS

Figure 1:
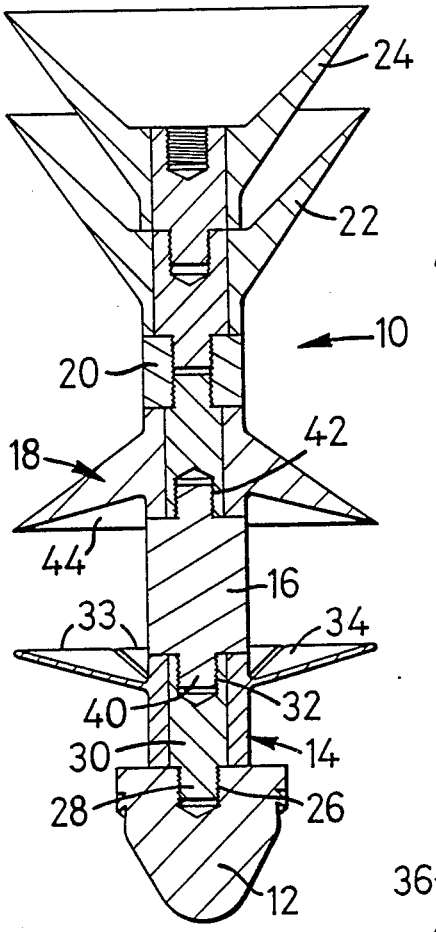
FIG. 1 is a cross-sectional view of a plug according to the present invention, the dotted line indicating the center of the plug.
Figure 3:
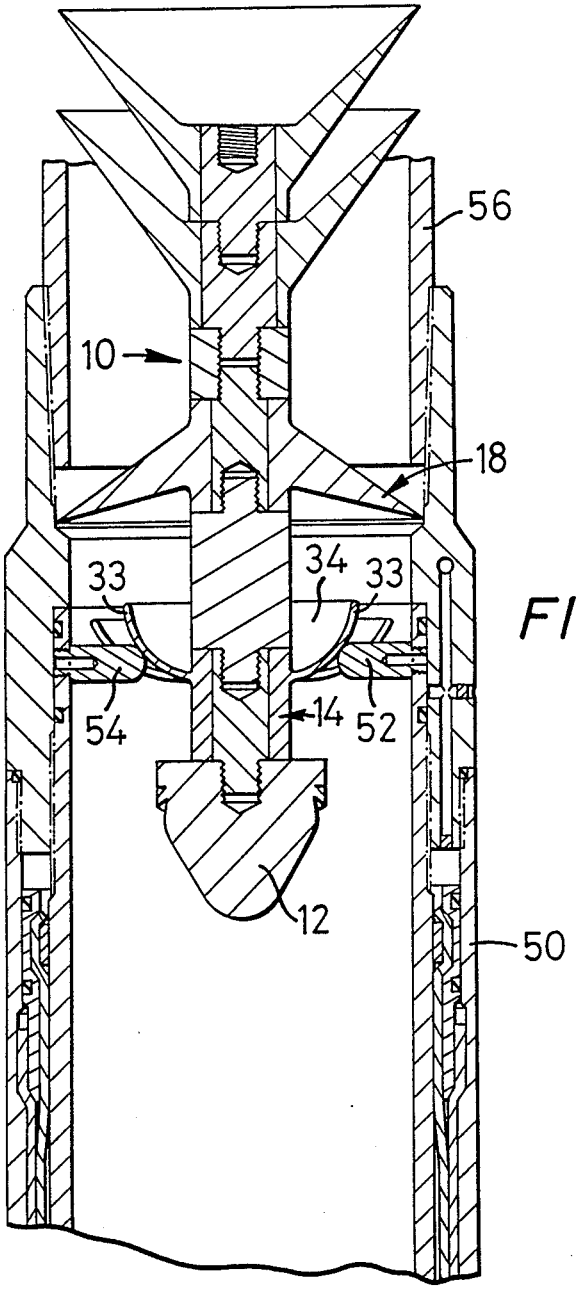
FIG. 3 is a cross-sectional view of a plug according to the present invention within a packer in a wellbore at the point at which the plug is contacting breakaway members.
Figure 4:
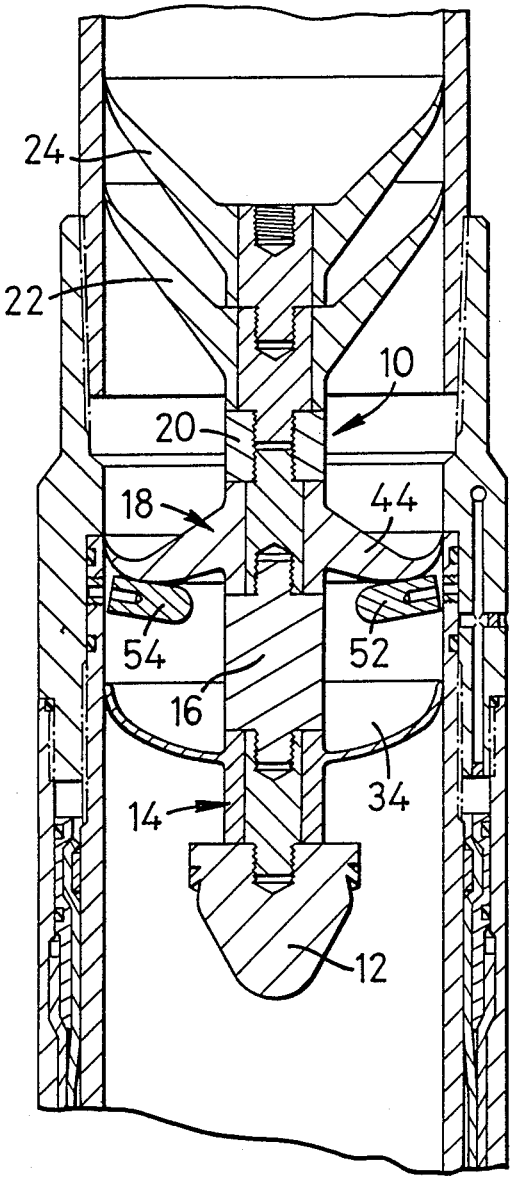
FIG. 4 is a view of the plug of FIG. 3 as it breaks off the breakaway members.

FIGS. 1, 3 and 4 illustrate the pump down plug 10 for use in cementing operations. The plug 10 has the plug head 12 to which is threadedly connected the lead cup 14. The axial spacer 16 is threadedly connected to the lead cup 14 on one end and to the middle cup 18 on the other end. The connector 20 is threadedly connected at one end to the middle cup 18 and at the other end threadedly to the second rear cup 22. The second rear cup 22 is threadedly connected to the first rear cup 24.

The plug head 12 is preferably made from an easily drillable material such as aluminum. It has the threadedly female recess 26 for threadedly receiving the male nose 28 of the lead cup 14. The nose 28 is formed integrally of the shaft 30 of the cup 14. The threaded female recess 32 in the cup 14 engages the nose 40 of the axial spacer 16.

Figure 2:
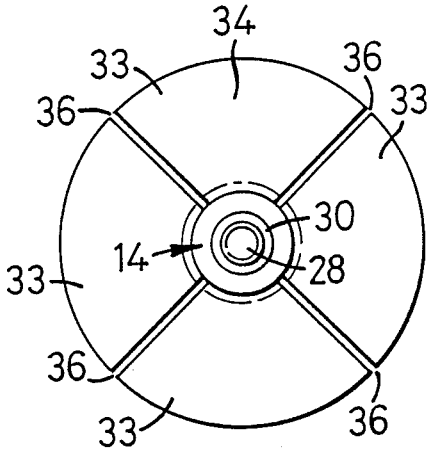
FIG. 2 is a top view in cross section of the lead cup of the plug of FIG. 1.

The lead cup 14 has the flexible cone 34 formed integrally of the shaft 30. As shown in FIG. 2, the cone 34 has a plurality of radial splits 36 therethrough forming the radial portions 33 of the cone. The relatively thin cross section of the cone 34 and the radial splits render the cone 34 relatively more flexible so that it does not break frangible members encountered by the plug.

The axial spacer 16 is threadedly connected to the female recess 42 of the middle cup 18. The cone 44 of the middle cup 18 is made thick enough, rigid enough, and/or strong enough to break selected frangible breakaway members which the plug 10 will encounter. The length of the axial spacer 16 is chosen so that sufficient movement of the plug allows the cone 34 of the lead cup 14 to pass a breakaway member before the cone 44 of the middle cup 18 breaks it off. After the breakaway member has been broken, it is prevented from migrating forward of the plug head 12 by the cone 34 and from migrating rearward by the cone 44.

FIGS. 3 and 4 illustrate the operation of the plug 10. As shown in FIG. 3 the plug 10 has entered the packer 50 in the casing string 56 and the cone 34 of the lead cup 14 has encountered the breakaway plugs 52 and 54 of the packer 50. Radial portions 33 in contact with the plugs 52 and 54 have bent upwardly. The middle cup 18 has not yet contacted the plugs 52 and 54. The plugs 52 and 54 seal off packer inflation passages during running of the casing string.

As shown in FIG. 4 the cone 34 has passed the plugs 52, 54 and the cone 44 has contacted and broken the plugs. The radial portions 33 of the cone 34 have resumed their normal position and prevent the broken-off plug parts from falling ahead of or migrating ahead of the plug 10. Also in the embodiment shown in FIG. 4, the broken off parts are maintained in the space between the leading edge of the cone 44, the rear of the cone 34, the interior wall of the packer 50 and the surface of the axial spacer 16 so that they cannot move to the area at the rear (top) of the plug 10 or to the area in front of the plug.

Figure 5:
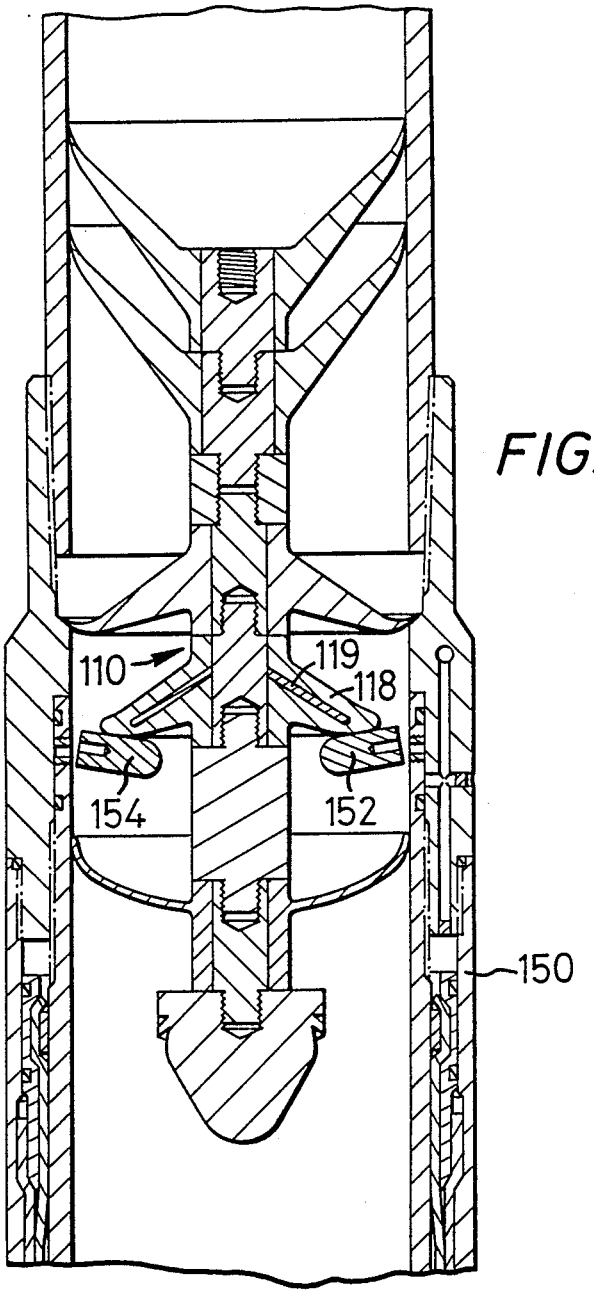
FIG. 5 is a cross-sectional view of a plug according to the present invention, the dotted line indicating the center of the plug.

The embodiment of the plug 110 according to the present invention shown in FIG. 5 has the breakaway cup 118 which has a cone of lesser diameter than the cone 44 of the plug 10. Nevertheless, the cone 118 is sufficiently large that it can effectively contact breakaway members such as the plugs 152 and 154 of the packer 150. The cone 118 also has the rigid inner member 119 made of metal or plastic which strengthens the cone 118 and enhances the plugs ability to break breakaway members.

In conclusion, therefore, it is seen that the present invention and the preferred embodiments disclosed herein is well adapted to carry out the objectives and obtain the ends set forth as well as others inherent therein. To one of skill in this art who has the benefit of this invention's teachings it will be clear that certain changes can be made in the various plugs and wipers disclosed herein without departing from the spirit of the invention and its scope as defined in the following claims.

What is claimed is:

1. A wellbore plug for use in a cased wellbore wherein breakaway plugs protrude into the casing, the wellbore plug comprising shaft means, first flexible wiper means mounted on the shaft means, breaking means for breaking the breakaway plugs, the breaking means mounted on the shaft means and spaced apart from the first flexible wiper means, the breaking means having insert means for providing rigidity to enhance the breaking means ability to break the breakaway plugs, second flexible wiper means mounted on the shaft means and spaced apart from the breaking means, the breaking means mounted at an intermediate position between the first flexible wiper means and the second flexible wiper means, the first flexible wiper means flexible enough to bypass one or more of the breakaway plugs without breaking them, and the breaking means rigid enough for breaking one or more of the breakaway plugs bypassed by the first flexible wiper means.

2. A wellbore plug for use in a cased wellbore wherein breakaway plugs protrude into the casing, the wellbore plug comprising shaft means, first flexible wiper means mounted on the shaft means, the first flexible wiper means comprising a plurality of radially extending portions, each portion flexible independently of other portions, breaking means for breaking the breakaway plugs, the breaking means mounted on the shaft means and spaced apart from the first flexible wiper means, second flexible wiper means mounted on the shaft means and spaced apart from the breaking means, the breaking means mounted at an intermediate position between the first flexible wiper means and the second flexible wiper means, the radially extending portions of first flexible wiper means flexible enough to bypass one or more of the breakaway plugs without breaking them, and the breaking means rigid enough for breaking one or more of the breakaway plugs bypassed by the first flexible wiper means.

* * * * *